US006453660B1

(12) United States Patent
Johnson et al.

(10) Patent No.: US 6,453,660 B1
(45) Date of Patent: Sep. 24, 2002

(54) COMBUSTOR MIXER HAVING PLASMA GENERATING NOZZLE

(75) Inventors: Arthur Wesley Johnson, Cincinnati, OH (US); Timothy James Held, Blanchester, OH (US); Hukam Chand Mongia, West Chester, OH (US); Michael Louis Vermeersch, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 1 day.

(21) Appl. No.: 09/764,638

(22) Filed: Jan. 18, 2001

(51) Int. Cl.[7] ..... F02C 7/266
(52) U.S. Cl. ..... 60/39.821; 60/746
(58) Field of Search ..... 60/39.821, 39.827, 60/737, 746

(56) References Cited

U.S. PATENT DOCUMENTS 5,515,681 A 5/1996 DeFreitas
5,689,949 A * 11/1997 DeFreitas et al. ..... 60/39.821
5,861,600 A 1/1999 Jensen
5,946,917 A 9/1999 Hums et al.
5,968,378 A 10/1999 Jensen
6,038,854 A 3/2000 Penetrante et al.
6,182,436 B1 * 2/2001 Prociw et al. ..... 60/39.821
6,272,840 B1 * 8/2001 Crocker et al. ..... 60/746
6,141,967 A1 * 11/2001 Angel et al. ..... 60/737

* cited by examiner

*Primary Examiner*—Michael Koczo

(57) ABSTRACT

A mixer assembly for use in a combustion chamber of a gas turbine engine. The mixer assembly includes a mixer housing having a hollow interior, an inlet and an outlet. The housing delivers a mixture of fuel and air through the outlet to the combustion chamber for burning. The mixer assembly includes a fuel nozzle assembly mounted in the housing having a fuel passage adapted for connection to a fuel supply. The passage extends to an outlet port for delivering fuel from the passage to the hollow interior of the mixer housing. The nozzle assembly includes a plasma generator for generating at least one of a dissociated fuel and an ionized fuel from the fuel delivered through the nozzle outlet port to the hollow interior of the housing.

19 Claims, 6 Drawing Sheets

COMBUSTOR MIXER HAVING PLASMA GENERATING NOZZLE

BACKGROUND OF THE INVENTION

The present invention relates generally to gas turbine engine combustor mixers and more particularly to a combustor mixer having a plasma generating fuel nozzle.

Fuel and air are mixed and burned in combustors of gas turbine engines to heat flowpath gases. The combustors include an outer liner and an inner liner defining an annular combustion chamber in which the fuel and air are mixed and burned. A dome mounted at the upstream end of the combustion chamber includes mixers for mixing fuel and air. Ignitors mounted downstream from the mixers ignite the mixture so it burns in the combustion chamber.

Governmental agencies and industry organizations regulate the emission of nitrogen oxides (NOx) from gas turbine engines. These emissions are formed in the combustors due in part to high flame temperatures caused by high fuel-air ratios and/or poor fuel-air mixing. Efforts to reduce NOx emissions by reducing fuel-air ratios have led to lean blowout and acoustical vibration problems. Thus, there is a need in the industry for combustors having improved mixing and reduced emissions without blowout and acoustical vibrations.

SUMMARY OF THE INVENTION

Among the several features of the present invention may be noted the provision of a mixer assembly for use in a combustion chamber of a gas turbine engine. The mixer assembly comprises a mixer housing having a hollow interior, an inlet for permitting air to flow into the hollow interior and an outlet for permitting air to flow from the hollow interior to the combustion chamber. The housing delivers a mixture of fuel and air through the outlet to the combustion chamber for burning to heat air passing through the combustion chamber. Further, the mixer assembly includes a fuel nozzle assembly mounted in the housing having a fuel passage adapted for connection to a fuel supply for supplying the passage with fuel. The passage extends to an outlet port for delivering fuel from the passage to the hollow interior of the mixer housing to mix the fuel with air passing through the mixer housing. The nozzle assembly includes a plasma generator for generating at least one of a dissociated fuel and an ionized fuel from the fuel delivered through the nozzle outlet port to the hollow interior of the housing.

In another aspect, the mixer assembly comprises a mixer housing and a swirler assembly mounted in the mixer housing. The swirler assembly has a plurality of vanes adapted for swirling air passing through the hollow interior of the housing. Further the mixer assembly includes a fuel nozzle assembly having a plasma generator for generating at least one of a dissociated fuel and an ionized fuel from the fuel delivered through the nozzle outlet port to the hollow interior of the housing.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
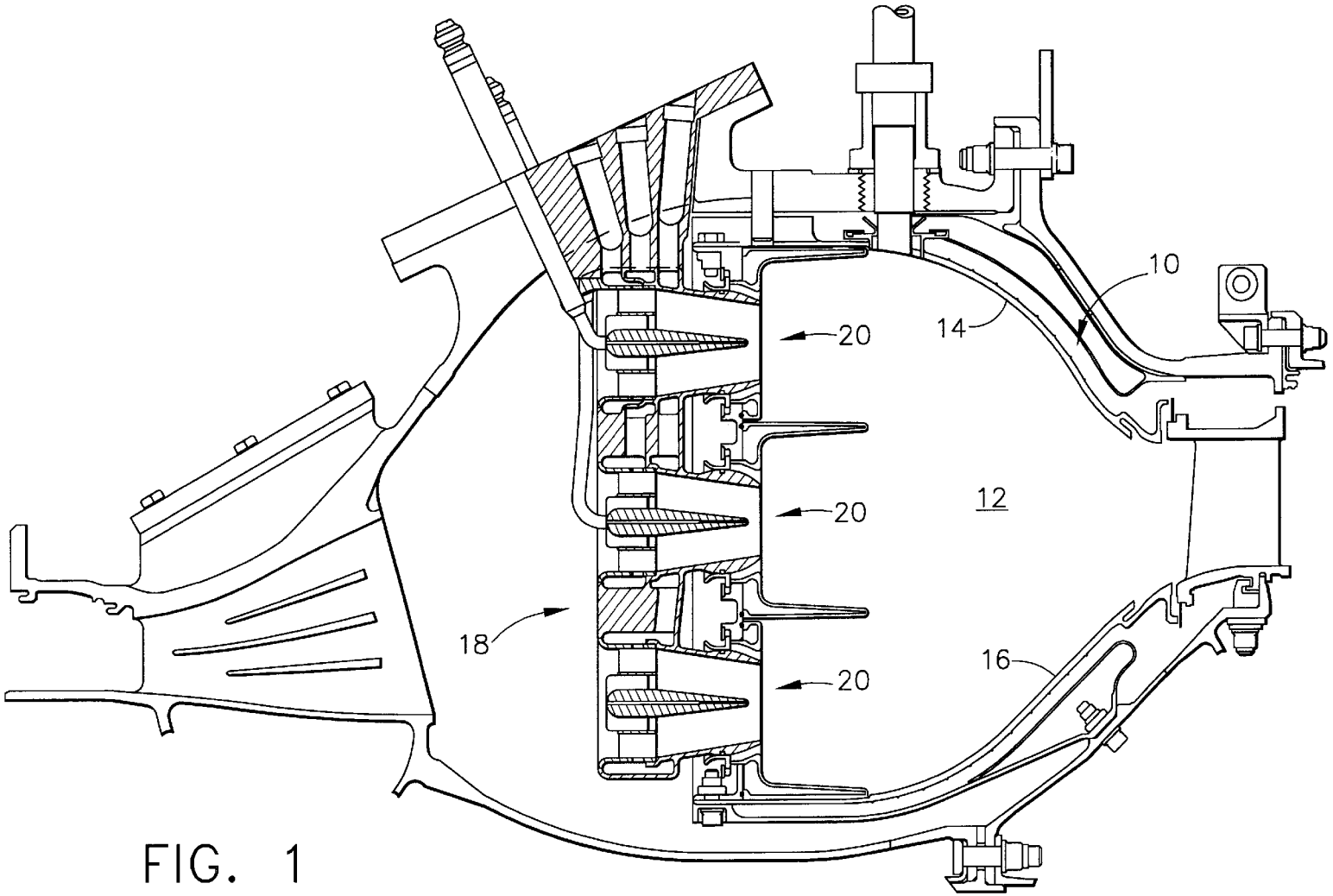
FIG. 1 is a vertical cross section of an upper half of a combustor having mixers including a nozzle of the present invention.

Referring to the drawings and in particular to FIG. 1, a portion of a gas turbine engine, and more particularly a combustor of the present invention is designated in its entirety by the reference number 10. The combustor 10 defines a combustion chamber 12 in which combustor air. is mixed with fuel and burned. The combustor 10 includes an outer liner 14 and an inner liner 16. The outer liner 14 defines an outer boundary of the combustion chamber 12, and the inner liner 16 defines an inner boundary of the combustion chamber. An annular dome, generally designated by 18, mounted upstream from the outer liner 14 and the inner liner 16 defines an upstream end of the combustion chamber 12. Mixer assemblies or mixers of the present invention, each generally designated by 20, are positioned on the dome 18. The mixer assemblies 20 deliver a mixture of fuel and air to the combustion chamber 12. Other features of the combustion chamber 12 are conventional and will not be discussed in further detail.

Figure 2:
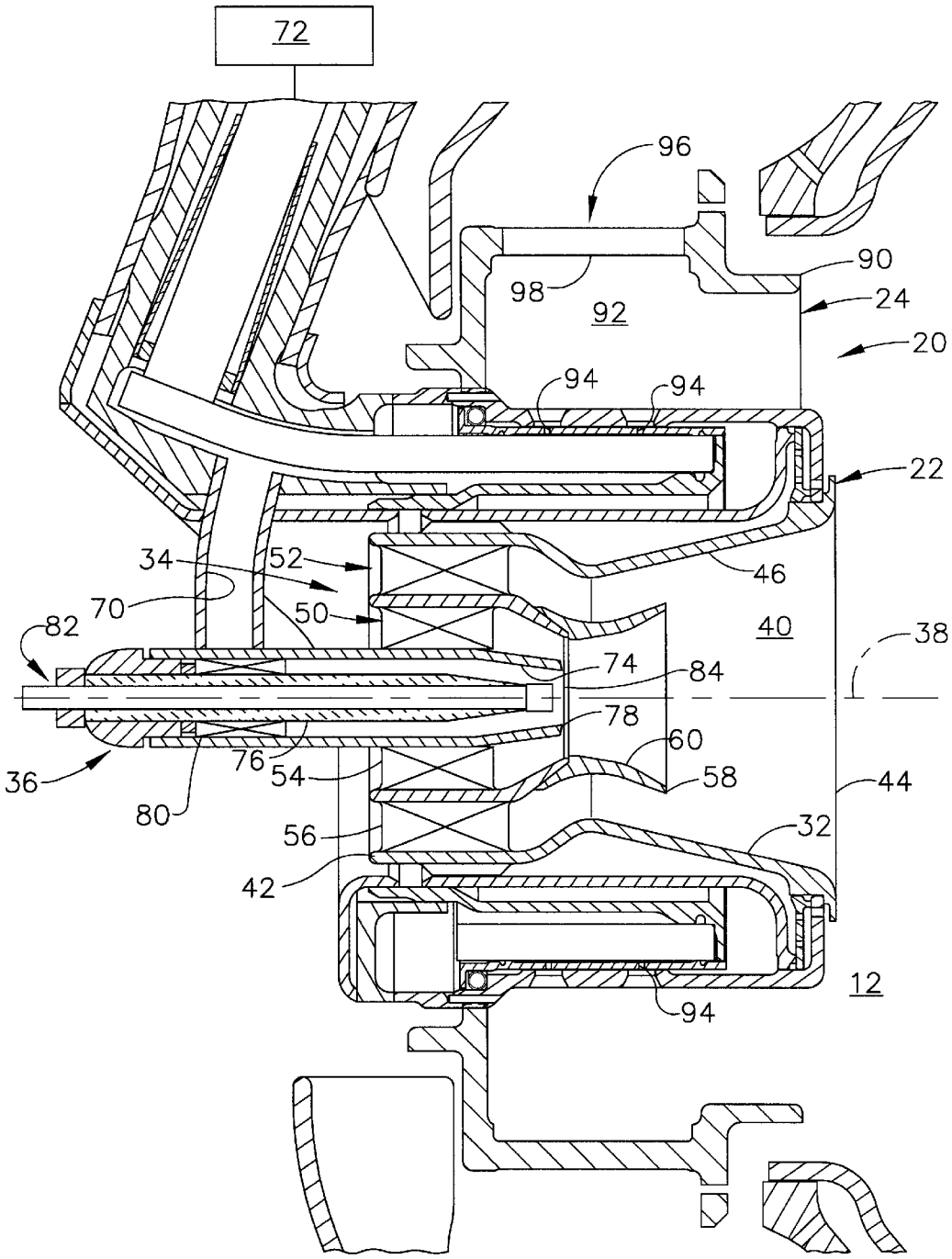
FIG. 2 is a vertical cross section of a mixer assembly of the present invention.

As illustrated in FIG. 2, each mixer assembly 20 generally comprises a pilot mixer assembly 22 and a main mixer assembly 24 surrounding the pilot mixer assembly. The pilot mixer assembly 22 includes an annular inner mixer housing 32, a swirler assembly, generally designated by 34, and a fuel nozzle assembly, generally designated by 36, mounted in the housing 32 along a centerline 38 of the pilot mixer 22. The housing 32 has a hollow interior 40, an inlet 42 at an upstream end of the hollow interior for permitting air to flow into the hollow interior and an outlet 44 at a downstream end of the interior for permitting air to flow from the hollow interior to the combustion chamber 12. Fuel and air mix in the hollow interior 40 of the housing 32 and are delivered through the outlet 44 to the combustion chamber 12 where they are burned to heat the air passing through the combustion chamber. The housing 32 has a converging-diverging inner surface 46 downstream from the swirler assembly 34 to provide controlled diffusion for mixing the fuel and air and to reduce the axial velocity of the air passing through the housing.

The swirler assembly 34 also includes a pair of concentrically mounted axial swirlers, generally designated by 50, 52, having a plurality of vanes 54, 56, respectively, positioned upstream from the fuel nozzle 36. Although the swirlers 50, 52 may have different numbers of vanes 54, 56 without departing from the scope of the present invention, in one embodiment the inner swirler 50 has ten vanes 54 and the outer swirler 52 has ten vanes 56. Each of the vanes 54, 56 is skewed relative to the centerline 38 of the pilot mixer 22 for swirling air traveling through the swirlers 50, 52 so it mixes with the fuel dispensed by the fuel nozzle 36 to form a fuel-air mixture selected for optimal burning during selected power settings of the engine. Although the pilot mixer 22 of the disclosed embodiment has two axial swirlers 50, 52, those skilled in the art will appreciate that the mixer may include fewer or more swirlers without departing from the scope of the present invention. As will further be appreciated by those skilled in the art, the swirlers 50, 52 may be configured alternatively to swirl air in the same direction or in opposite directions. Further, the housing 32 of the pilot mixer 22 may be sized and the pilot inner and outer swirler 50, 52 airflows and swirl angles may be selected to provide good ignition characteristics, lean stability and low emissions at selected power conditions.

An annular barrier 58 is positioned between the swirlers 50, 52 for separating airflow traveling through the inner swirler 50 from that flowing through the outer swirler 52. The barrier 58 has a converging-diverging inner surface 60 which provides a fuel filming surface to aid in low power performance. As will be appreciated by those skilled in the art, the geometries of the pilot mixer assembly 22, and in particular the shapes of the mixer housing inner surface 46 and t he barrier inner surface 60 may be selected to improve ignition characteristics, combustion stability and low CO and HC emissions.

The fuel nozzle assembly 36 is mounted inside the inner swirler 40 along the centerline 38 of the housing 32. A fuel manifold 70 delivers fuel to the nozzle assembly 36 from a fuel supply 72 (shown schematically in FIG. 2). Although other fuels and fuels in other states may be used without departing from the scope of the present invention, in one embodiment the fuel is natural gas. The manifold 70 delivers the fuel to an annular passage 74 formed in the nozzle assembly 36 between a centrally-located insulator 76 and a tubular housing 78 surrounding the insulator. A plurality of vanes 80 are positioned at an upstream end of the passage 74 for swirling the fuel passing through the passage. The nozzle assembly 36 also includes a plasma generator, generally designated by 82, for ionizing and/or dissociating fuel delivered through an outlet port 84 of the nozzle assembly to the hollow interior 40 of the housing 32. As illustrated in FIG. 2, the outlet port 84 is positioned downstream from the swirler assembly at a downstream end of nozzle assembly 36. In the case in which the fuel is a natural gas, the plasma generator 82 converts a portion of the fuel into partially dissociated and ionized hydrogen, acetylene and other $C_xH_y$ species.

The main mixer 24 includes a main housing 90 surrounding the pilot housing 32 and defining an annular cavity 92. A portion of the fuel manifold 70 is mounted between the pilot housing 32 and the main housing 90. The manifold 70 has a plurality of fuel injection ports 94 for introducing fuel into the cavity 92 of the main mixer 24. Although the manifold 70 may have a different number of ports 94 without departing from the scope of the present invention, in one embodiment the manifold has a forward row consisting of six evenly spaced ports and an aft row consisting of six evenly spaced ports. Although the ports 94 are arranged in two circumferential rows in the embodiment shown in FIG. 2, those skilled in the art will appreciate that they may be arranged in other configurations without departing from the scope of the present invention. As will also be understood by those skilled in the art, using two rows of fuel injector ports at different axial locations along the main mixer cavity provides flexibility to adjust the degree of fuel-air mixing to achieve low NOx and complete combustion under variable conditions. In addition, the large number of fuel injection ports in each row provides for good circumferential fuel-air mixing. Further, the different axial locations of the rows may be selected to prevent combustion instability.

The pilot mixer housing 32 physically separates the pilot mixer interior 40 from the main mixer cavity 92 and obstructs a clear line of sight between the fuel nozzle 36 and the main mixer cavity. Thus, the pilot mixer 22 is sheltered from the main mixer 24 during pilot operation for improved pilot performance stability and efficiency and reduced CO and HC emissions. Further, the pilot housing 90 is shaped to permit complete burnout of the pilot fuel by controlling the diffusion and mixing of the pilot flame into the main mixer 24 airflow. As will also be appreciated by those skilled in the art, the distance between the pilot mixer 22 and the main mixer 24 may be selected to improve ignition characteristics, combustion stability at high and lower power and low CO and HC emissions at low power conditions.

The main mixer 24 also includes a swirler, generally designated by 96, positioned upstream from the plurality of fuel injection ports 94. Although the main swirler 96 may have other configurations without departing from the scope of the present invention, in one embodiment the main swirler is a radial swirler having a plurality of radially skewed vanes 98 for swirling air traveling through the swirler to mix the air and the droplets of fuel dispensed by the ports 94 in the fuel manifold 70 to form a fuel-air mixture selected for optimal burning during high power settings of the engine. Although the swirler 96 may have a different number of vanes 98 without departing from the scope of the present invention, in one embodiment the main swirler has twenty vanes. The main mixer 24 is primarily designed to achieve low NOx under high power conditions by operating with a lean air-fuel mixture and by maximizing the fuel and air pre-mixing. The radial swirler 96 of the main mixer 24 swirls the incoming air through the radial vanes 98 and establishes the basic flow field of the combustor 10. Fuel is injected radially outward into the swirling air stream downstream from the main swirler 96 allowing for thorough mixing within the main mixer cavity 92 upstream from its exit. This swirling mixture enters the combustion chamber 12 where it is burned completely.

Figure 3:
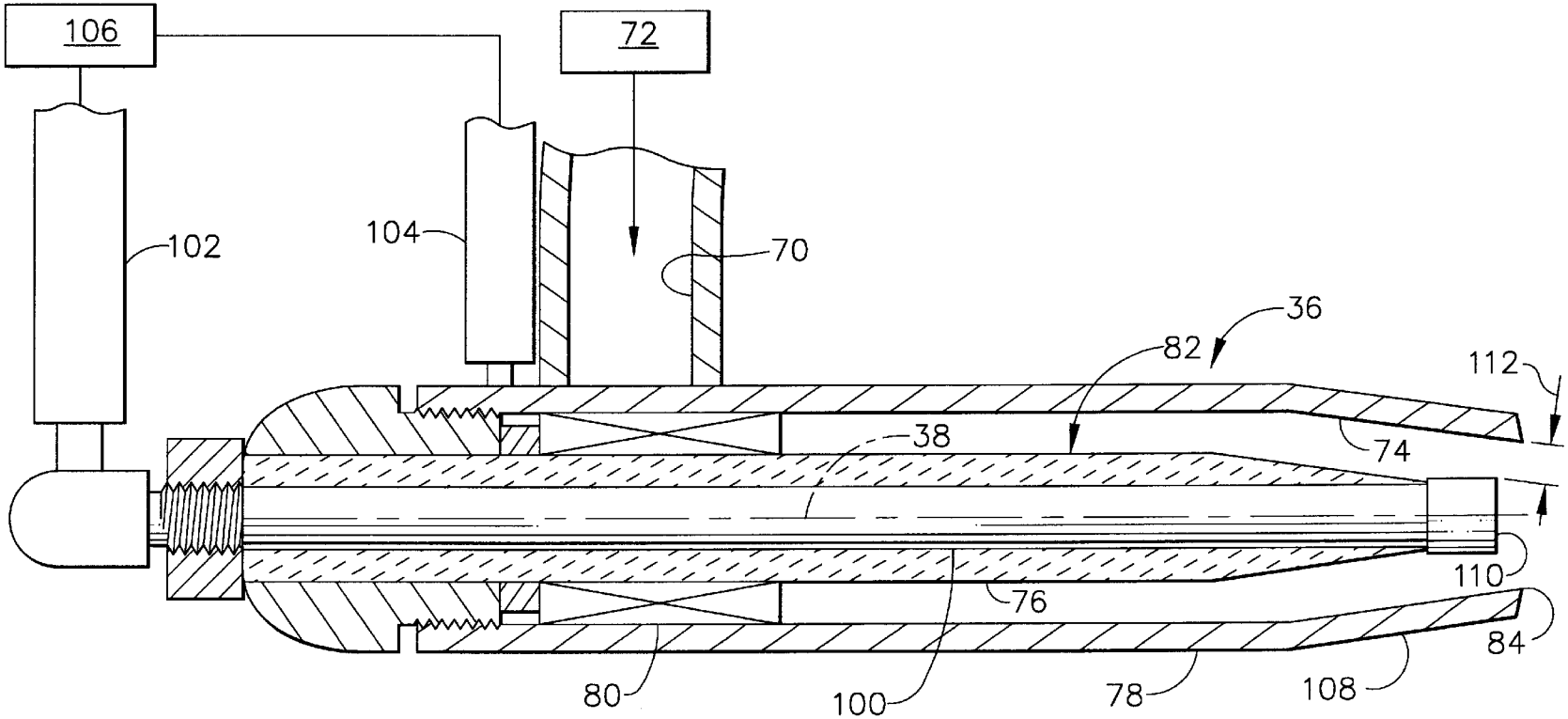
FIG. 3 is a vertical cross section of a nozzle of a first embodiment of the present invention.

In one embodiment illustrated in FIG. 3, the plasma generator 82 is an electrical discharge plasma generator comprising an electrode 100 extending through the centrally-located insulator 76. The electrode 100 and housing 78 are connected to electrical cables 102, 104, respectively, which extend to an electrical power supply 106 (shown schematically in FIG. 3). The housing 78 has a tapered downstream end portion 108, and the electrode 100 includes a tip 110 positioned inside the end portion of the housing. The insulator 76 surrounds the electrode 100 along its entire length except at the tip 110 to inhibit electrical discharge between the electrode and housing 78 except between the tip of the electrode and the end portion 108 of the housing. The power supply 106 produces an electrical arc between the electrode 100 and the housing 78 which passes through the fuel traveling between the electrode tip 110 and the end portion 108 of the housing. As the fuel passes through the arc, the fuel becomes ionized and dissociated. As will be appreciated by those skilled in the art, a distance 112 between the electrode tip 110 and the end portion 108 and an amplitude of the electrical charge may be selected to facilitate ionization and dissociation of the fuel. Further, a rate of fuel passing through the passage 74 may be adjusted to control a rate at which ionized and dissociated fuel is generated.

Figure 4:
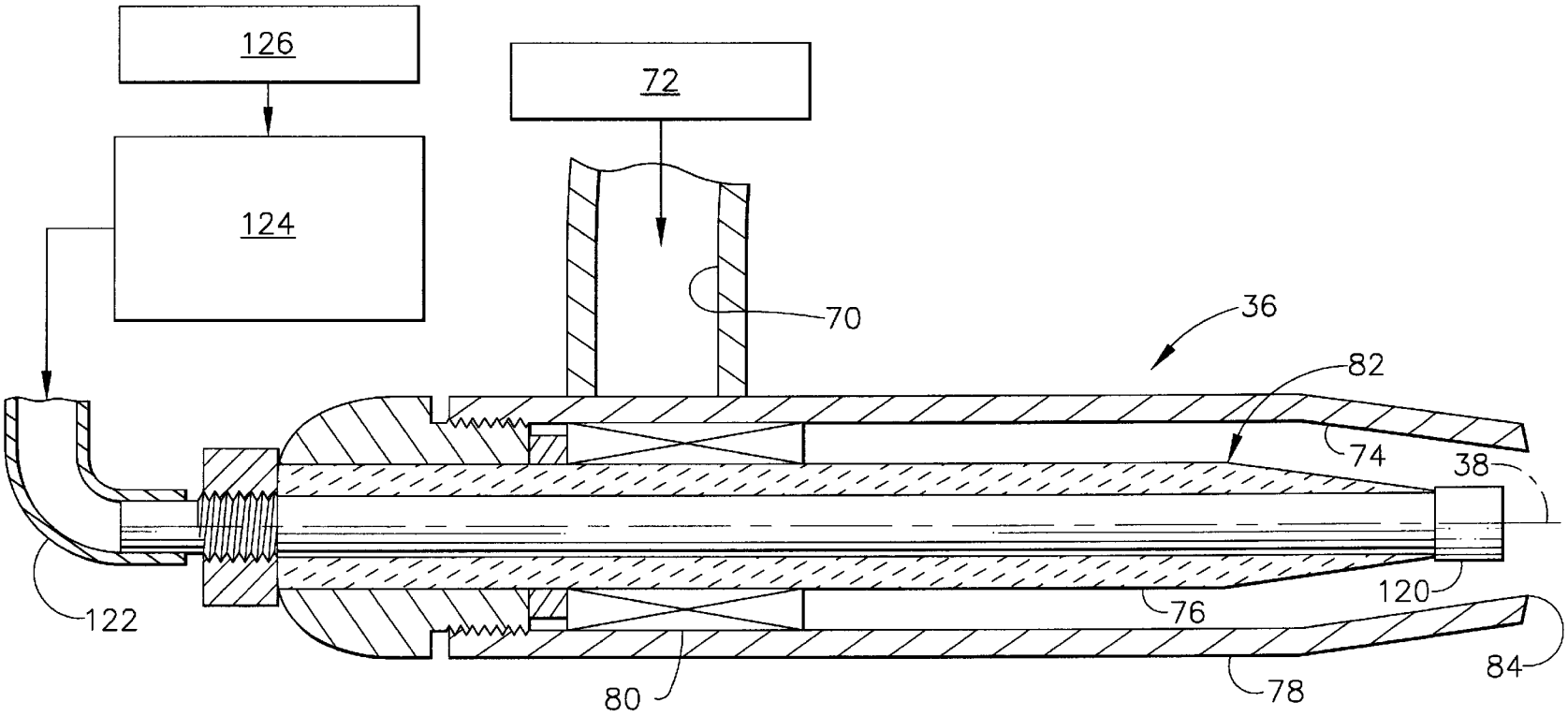
FIG. 4 is a vertical cross section of a nozzle of a second embodiment of the present invention.

In another embodiment illustrated in FIG. 4, the plasma generator 82 is a microwave discharge plasma generator comprising an electrode 120 extending through the centrally-located insulator 76. The electrode 120 is connected to a wave guide 122 which extends to a magnetron 124 connected to an electrical power supply 126 (shown schematically in FIG. 4). The power supply 126 powers the magnetron 124 which directs a microwave signal through the wave guide 122 to the electrode 120 which discharges microwave energy to the fuel passing downstream from the electrode to ionize and dissociate the fuel. As will be appreciated by those skilled in the art, the microwave signal may be adjusted to facilitate ionization and dissociation of the fuel. Further, a rate of fuel passing through the passage 74 may be adjusted to control a rate at which ionized and dissociated fuel is generated.

Figure 5:
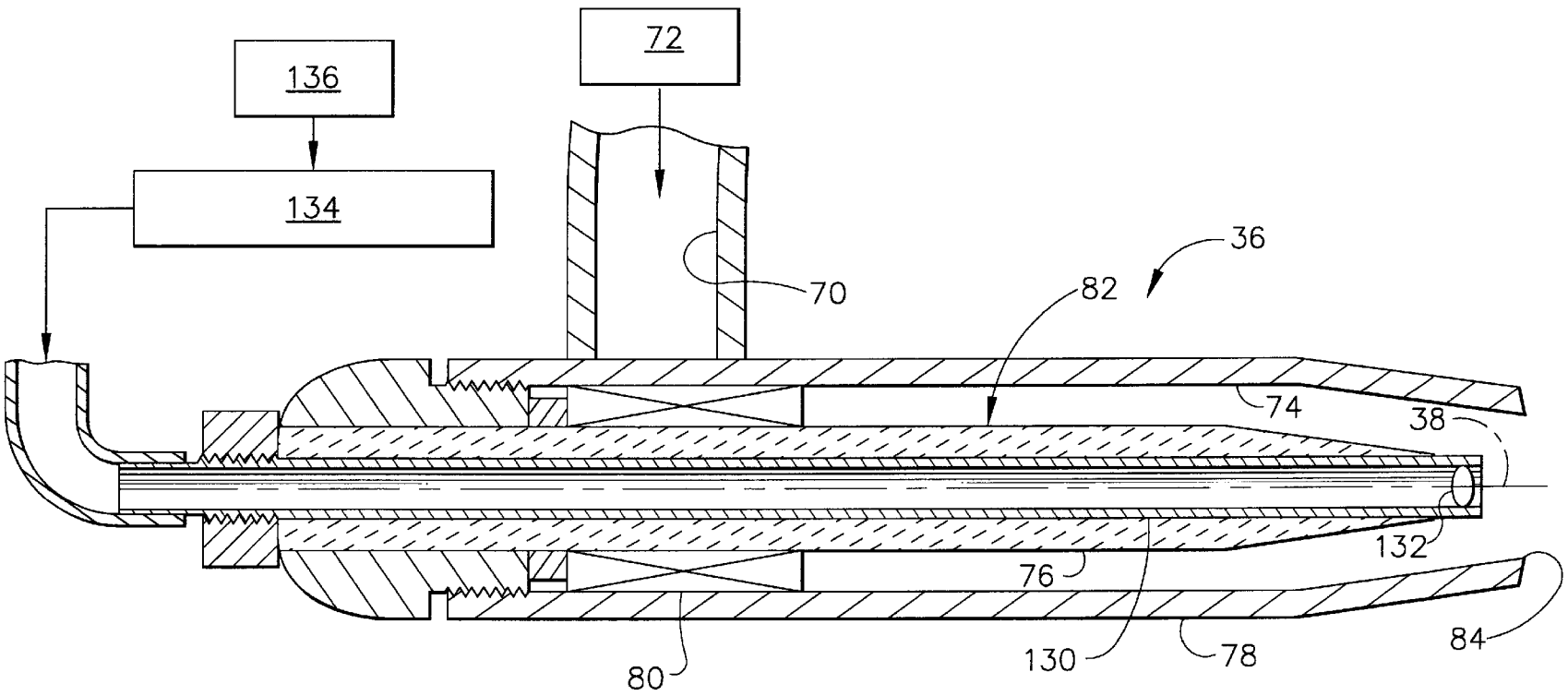
FIG. 5 is a vertical cross section of a nozzle of a third embodiment of the present invention.

In yet another embodiment illustrated in FIG. 5, the plasma generator 82 is a laser plasma generator comprising an optical wave guide 130 extending through the centrally-located insulator 76 to a lens 132 adapted to focus the laser downstream from the guide 130. The wave guide 130 is connected to a laser 134 connected to an electrical power supply 136 (shown schematically in FIG. 5). The power supply 136 powers the laser 134 which directs light energy along the wave guide 130 to the lens 132 where the energy travels through the fuel traveling downstream from the lens to ionize and dissociate the fuel.

Figure 6:
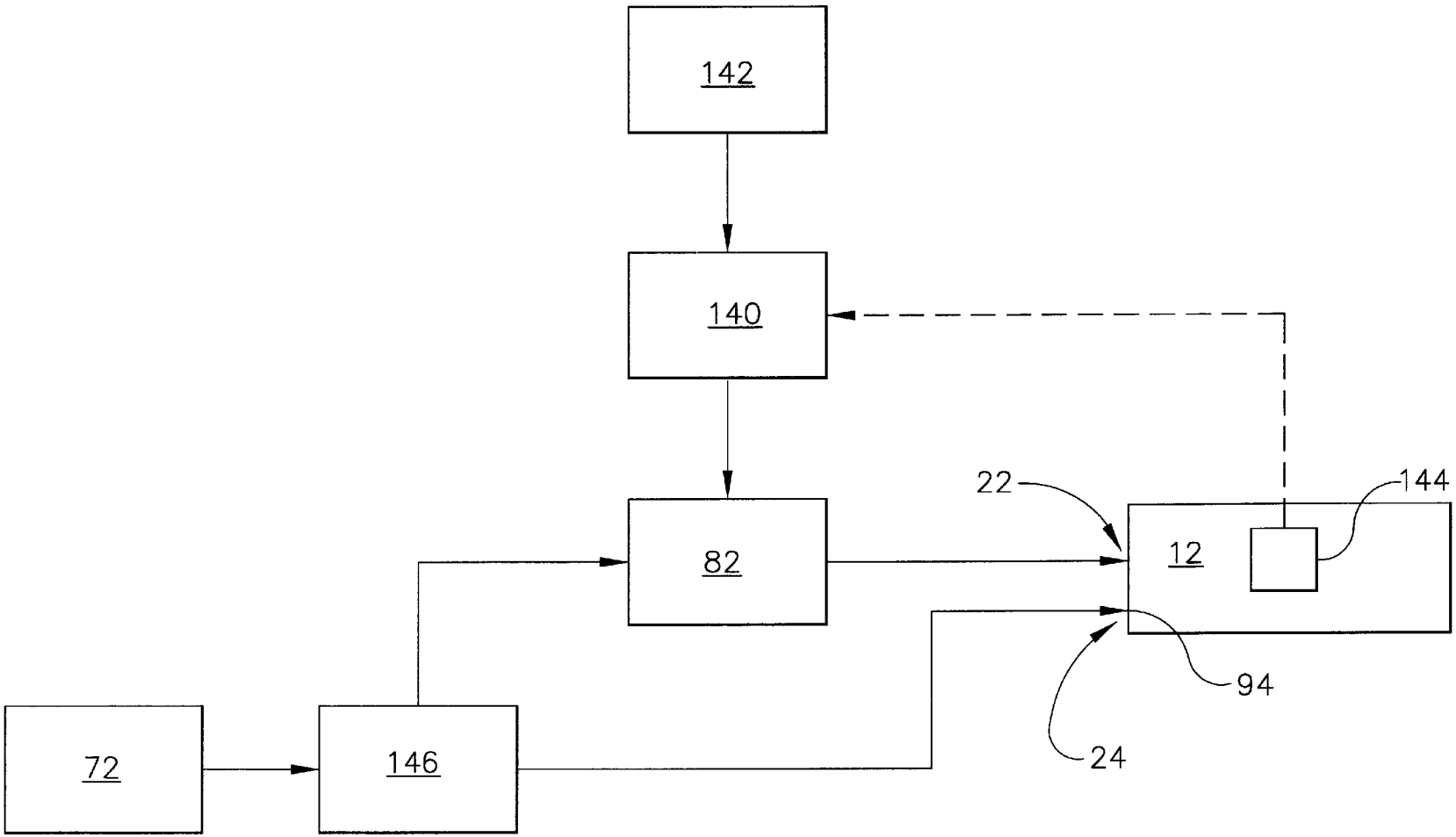
FIG. 6 is a schematic of a plasma generator control circuit of the present invention.

Although the plasma generator 82 may operate to continuously generate plasma, in one embodiment schematically illustrated in FIG. 6 the plasma generator is operatively connected to an electronic combustor control 140 which pulses the generator at a preselected frequency, to a preselected amplitude and at a preselected phase relative to pressure pulses in the combustion chamber 12 to eliminate or reduce thermo-acoustical vibrations in the chamber. The control 140 is powered by a conventional electrical power supply 142. A pressure sensor 144 mounted in the combustion chamber 12 measures pressure pulses in the chamber and sends a corresponding signal to the control 140. Further, a fuel flow controller 146 controls the amount of fuel flowing to the plasma generator 82 and through the ports 94 in the main mixer assembly 24 (FIG. 2).

The swirler assembly 34 swirls the incoming air passing through its vanes 54, 56 and establishes the basic flow field of the combustor 10. Plasma (i.e., ionized and dissociated fuel) generated by the plasma generator 82 is released into swirling air stream downstream from the vanes 54, 56 so the plasma and air are thoroughly mixed in the mixer housing interior 40. This swirling mixture enters the combustor chamber 12 where it is burned completely.

In operation, only the pilot mixer 22 is fueled during starting and low power conditions where low power stability and low CO/HC emissions are critical. The main mixer 24 is fueled during high power operation including takeoff, climb and cruise power settings for propulsion engines; intermediate, continuous and maximum rated power settings for ground operation engines including thoses used in shaft power and/or electrical generation applications. The fuel split between the pilot and main mixers is selected to provide good efficiency and low NOx emissions as is well understood by those skilled in the art.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. In combination, a mixer assembly for use in a combustion chamber of a gas turbine engine, said mixer assembly comprising:

a mixer housing having a hollow interior, an inlet for permitting air to flow into the hollow interior and an outlet for permitting air to flow from the hollow interior to the combustion chamber, said housing delivering a mixture of fuel and air through the outlet to the combustion chamber for burning therein thereby to heat air passing through the combustion chamber; and a fuel nozzle assembly mounted in the housing having a fuel passage adapted for connection to a fuel supply for supplying the passage with fuel, said passage extending to an outlet port for delivering fuel from the passage to the hollow interior of the mixer housing to mix said fuel with air passing through the mixer housing, wherein the nozzle assembly includes a plasma generator for generating at least one of a dissociated fuel and an ionized fuel from the fuel delivered through the nozzle outlet port to the hollow interior of the housing; and a combustor control operable for controlling a rate at which said at least one dissociated fuel and ionized fuel is generated by the plasma generator.

2. A combination as set forth in claim 1 wherein the plasma generator is operable for generating said at least one dissociated fuel and ionized fuel from a gaseous fuel.

3. A combination as set forth in claim 2 wherein the plasma generator is operable for generating at least one dissociated fuel and ionized fuel from natural gas.

4. A combination as set forth in claim 1 wherein the combustor control is adapted to vary the rate at which said at least one dissociated fuel and ionized fuel is generated in response to measured pressure variations in the combustor chamber to reduce said pressure variations.

5. A combination as set forth in claim 1 wherein said plasma generator is an electrical discharge plasma generator.

6. A combination as set forth in claim 1 wherein said plasma generator is a microwave discharge plasma generator.

7. A combination as set forth in claim 1 wherein said plasma generator is a laser plasma generator.

8. In combination, a mixer assembly for use in a combustion chamber of a gas turbine engine, said mixer assembly comprising:

a mixer housing having a hollow interior, an inlet for permitting air to flow into the hollow interior and an outlet for permitting air to flow from the hollow interior to the combustion chamber, said housing delivering a mixture of fuel and air through the outlet to the combustion chamber for burning therein thereby to heat air passing through the combustion chamber;

a swirler assembly mounted in the mixer housing having a plurality of vanes for swirling air passing through the hollow interior of the housing; and a fuel nozzle assembly mounted in the mixer housing having a fuel passage adapted for connection to a gaseous fuel supply for supplying the passage with fuel, said passage extending to an outlet port of the nozzle assembly positioned downstream from the swirler assembly for delivering fuel to the swirling air downstream from the swirler to mix said fuel with said air, wherein the nozzle assembly includes a plasma generator for generating at least one of a dissociated fuel and an ionized fuel from the fuel delivered through the nozzle outlet port to the hollow interior of the housing; and a combustor control operable for controlling a rate at which said at least one dissociated fuel and ionized fuel is generated by the plasma generator.

9. A combination as set forth in claim 8 wherein the plasma generator is operable for generating said at least one dissociated fuel and ionized fuel from natural gas.

10. A combination as set forth in claim 8 wherein the combustor control is adapted to vary the rate at which said at least one dissociated fuel and ionized fuel is generated in response to measured pressure variations in the combustor chamber to reduce said pressure variations.

11. A combination as set forth in claim 8 wherein said plasma generator is an electrical discharge plasma generator.

12. A combination as set forth in claim 8 wherein said plasma generator is a microwave discharge plasma generator.

13. A combination as set forth in claim 8 wherein said plasma generator is a laser plasma generator.

14. A combination as set forth in claim 8 wherein said swirler assembly includes a plurality of swirlers, each of said plurality of swirlers having a plurality of vanes positioned for swirling air passing through the hollow interior of the housing thereby to improve mixing of the fuel and air.

15. A combination as set forth in claim 14 wherein each of said plurality of swirlers is an axial swirler.

16. A combination as set forth in claim 14 further comprising a barrier positioned between at least two of said plurality of swirlers.

17. A mixer assembly for use in a combustion chamber of a gas turbine engine, said mixer assembly comprising:

a mixer housing having a hollow interior, an inlet for permitting air to flow into the hollow interior and an outlet for permitting air to flow from the hollow interior to the combustion chamber, said housing delivering a mixture of fuel and air through the outlet to the combustion chamber for burning therein thereby to heat air passing through the combustion chamber;

a swirler assembly mounted in the mixer housing including a plurality of swirlers, each of said plurality of swirlers having a plurality of vanes positioned for swirling air passing through the hollow interior of the housing thereby to improve mixing of the fuel and air;

a barrier positioned between at least two of said plurality of swirlers having a converging-diverging inner surface downstream from said two swirlers; and a fuel nozzle assembly mounted in the mixer housing having a fuel passage adapted for connection to a gaseous fuel supply for supplying the passage with fuel, said passage extending to an outlet port of the nozzle assembly positioned downstream from the swirler assembly for delivering fuel to the swirling air downstream from the swirler to mix said fuel with said air, wherein the nozzle assembly includes a plasma generator for generating at least one of a dissociated fuel and an ionized fuel from the fuel delivered through the nozzle outlet port to the hollow interior of the housing.

18. A combination as set forth in claim 8 in combination with a combustion chamber comprising:

an annular outer liner defining an outer boundary of the combustion chamber;

an annular inner liner mounted inside the outer liner and defining an inner boundary of the combustion chamber; and an annular dome mounted upstream from the outer liner and the inner liner and defining an upstream end of the combustion chamber, said mixer assembly being mounted on the dome for delivering a mixture of fuel and air to the combustion chamber.

19. A mixer assembly as set forth in claim 17 in combination with a combustion chamber comprising:

an annular outer liner defining an outer boundary of the combustion chamber;

an annular inner liner mounted inside the outer liner and defining an inner boundary of the combustion chamber; and an annular dome mounted upstream from the outer liner and the inner liner and defining an upstream end of the combustion chamber, said mixer assembly being mounted on the dome for delivering a mixture of fuel and air to the combustion chamber.

* * * * *